United States Patent [19]

Adrian et al.

[11] Patent Number: 4,836,353

[45] **Date of Patent: * Jun. 6, 1989**

[54] GUIDE FOR MOVING HANDRAIL

[75] Inventors: Willy Adrian, Obernkirchen; Martin Mehlert, Nienstaedt, both of Fed. Rep. of Germany

[73] Assignee: Otis Elevator Company, Farmington, Conn.

[ * ] Notice: The portion of the term of this patent subsequent to Apr. 21, 2004 has been disclaimed.

[21] Appl. No.: 99,179

[22] Filed: Sep. 18, 1987

[51] Int. Cl.[4] ..... B66B 23/24

[52] U.S. Cl. ..... 198/335; 52/397

[58] Field of Search ..... 198/335–338; 52/184, 393, 397, 399–403, 716, 717.1, 718.1, 823, 824; 49/441; 256/24, 68, 70; 248/74.2, 222.1

[56] References Cited

U.S. PATENT DOCUMENTS

| | | | |
|---|---|---|---|
| 2,028,358 | 1/1936 | Shonnard . | |
| 3,926,296 | 12/1975 | Woodling et al. | 198/335 X |
| 3,981,118 | 9/1976 | Johnson et al. | 52/393 X |
| 4,658,946 | 4/1987 | Adrian et al. | 198/337 |
| 4,705,155 | 11/1987 | Kanamori | 198/335 |

FOREIGN PATENT DOCUMENTS

| | | | |
|---|---|---|---|
| 0073487 | 6/1977 | Japan | 198/335 |
| 1122527 | 2/1967 | United Kingdom | 198/338 |
| 2104471 | 3/1983 | United Kingdom . | |
| 2143194 | 2/1985 | United Kingdom . | |
| 2152002 | 7/1985 | United Kingdom . | |

*Primary Examiner*—Robert J. Spar
*Assistant Examiner*—Lyle K. Kimms
*Attorney, Agent, or Firm*—William W. Jones

[57] ABSTRACT

A guide for supporting a moving handrail or an escalator or moving walk is formed from a sheet of rolled spring steel or the like. The guide fits onto the top edge of a glass balustrade on the escalator or walk. The guide is secured to the glass balustrade solely by means of a spring clamping action which results from stressing the guide when it is forced down over the glass. The guide is formed with opposed planar clamping surfaces which flank the glass balustrade and are biased inwardly thereagainst by outer radiused edges of the guide which are stressed when the guide is pressed onto the glass. The radiused edges, when stressed, act as hairpin or torsion springs to force the clamp surfaces toward the glass. A gasket of paper or plastic is mounted directly on the glass for engagement by the clamping surfaces to provide increased protection for the glass.

6 Claims, 1 Drawing Sheet

GUIDE FOR MOVING HANDRAIL

DESCRIPTION

CROSS REFERENCE TO RELATED APPLICATIONS

This invention is related to the subject matter of commonly-owned U.S. Pat. No. 4,658,946, issued Apr. 21, 1987.

TECHNICAL FIELD

The invention herein relates to a guide for a moving handrail, which guide is fastened to a glass balustrade solely by a clamping force provided by stressing the guide when it is pressed onto the balustrade.

BACKGROUND ART

Escalators and moving walkways, such as may be found in airports or the like, are frequently provided with glass sides or balustrades upon which are mounted moving handrails. The handrail slides over a guide member which in turn is secured to the balustrade. A number of different systems have been developed for securing the guide rail to the balustrade. These systems include the use of adhesive for gluing the guide to the balustrade, bolts and clamps for clamping the guide to the balustrade, and the use of bolts or screws for stressing the guide rail so that it can be clamped on the glass balustrade. Disclosures which typify the aforesaid securement systems are found in U.S. Pat. No. 2,028,358 Shonnard; U. K. Pat. Document No. 2,104,471; U. K. Patent Document No. 2,143,194; and U. K. Patent Document No. 2,152,002. The prior art systems described above have shortcomings which are as follows. The use of an adhesive is very messy and very difficult to disassemble. Bolting the guide to the glass involves many component parts, and also reqires drilling holes through the glass which is undesirable. Using screws, nuts and/or bolts to stress the guide rail for clamping purposes can result in breaking of the glass and also involves many component parts, which is undesirable.

DISCLOSURE OF THE INVENTION

The guide rail of this invention is a one piece part which is formed from a sheet of rolled spring steel as is shown in U.S. Pat. No. 4,658,946, Adrian et al., the disclosure of which is incorporated into this disclosure in its entirety. The securement force which fixes the guide rail to the glass balustrade is a spring clamping force which arises solely from internal stress imparted to the guide rail when it is forced onto the balustrade. The guide rail has two opposed planar clamp portions which are not bridged since they are formed by opposite ends of the sheet from which the guide rail is formed. Outwardly of the clamp portions are radiused spring wing portions in which resides most of the stress imparted to the guide when mounted on the balustrade. These spring wings strongly bias the clamp portions toward each other and against the balustrade. A gasket of paper or plastic is mounted on the top of the glass balustrade for direct contact with the guide rail clamp portion to protect the glass in the guide-balustrade joint. The connection thus achieved is sturdy, does not require drilling or other working of the glass, can be quickly achieved, and has a preset clamping force so as to ensure no damage to the glass.

It is therefore an object of this invention to provide a guide for a moving handrail on an escalator or the like which is secured to the top edge of a glass balustrade solely by spring clamping force.

It is a further object of this invention to provide a guide of the character described which is formed from a flat sheet of spring steel or the like rolled into a guiding and clamping configuration.

It is another object of this invention to provide a guide of the character described which has a pair of opposed planar end clamping portions which are biased against the side of the glass balustrade.

It is an additional object of this invention to provide a guide of the character described which has a pair of curved spring wing portions which are stressed to bias the clamping portion onto the balustrade.

It is yet another object of this invention to provide a handrail guiding assembly utilizing a gasket conforming to the top margin of the glass balustrade which the clamping portions of the guide grip.

These and other objects and advantages of the invention will become more readily apparent from the following detailed description of a preferred embodiment thereof when taken in conjunction with the accompanying drawings.

BEST MODE FOR CARRYING OUT THE INVENTION

Figure 1:
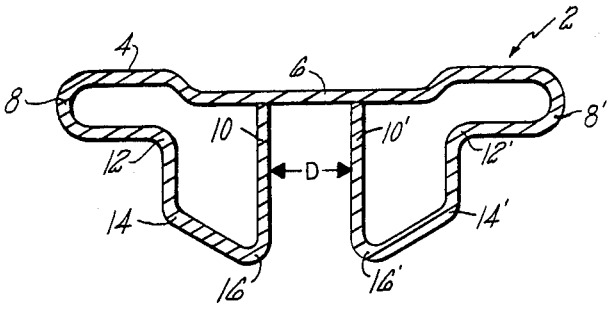
FIG. 1 is a transverse sectional view of a preferred embodiment of a rail guide formed in accordance with this invention.
Figure 2:
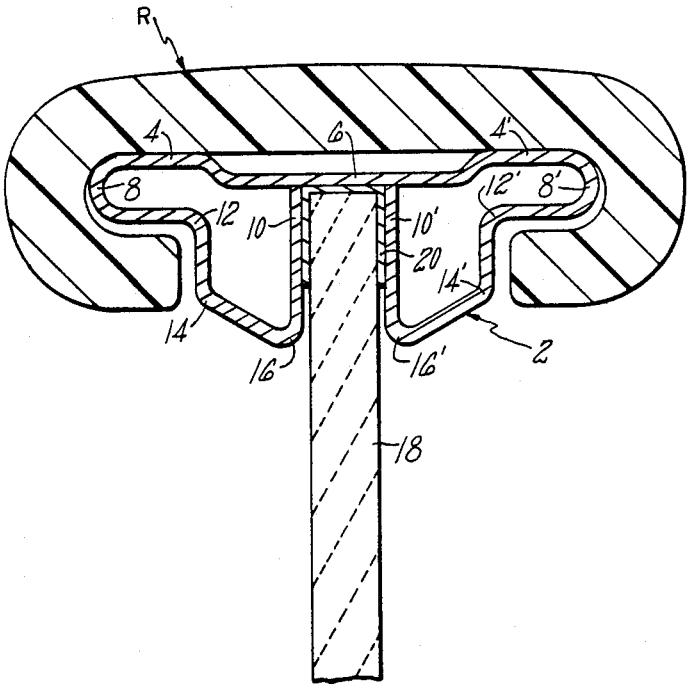
FIG. 2 is a similar view showing the guide mounted on the balustrade and the rail as it rides over the guide.

Referring now to the drawings, the rail guide denoted generally by the numeral 2, is shown in FIG. 1. It will be appreciated that the rail guide 2 is formed from a single strip of material such as stainless steel which is rolled into the cross-sectional configuration shown in the drawings. The guide can also be made of zinc plated sheet steel, bronze sheet metal or the like. The guide 2 includes a pair of coplanar raised marginal flat portions 4 and 4' which provide contact support for the moving handrail R to counter downwardly directed forces. These contact portions 4 and 4' are relatively restricted in lateral dimension to minimize frictional drag on the handrail R. The contact portions 4 and 4' are separated by a downwardly offset medial portion 6 which does not contact the handrail R. Outwardly of the contact portions 4 and 4' are curved spring wing portions 8 and 8' which provide resistance to the lateral forces imposed on the handrail R in both directions. The wing portions 8 and 8' also receive the majority of the stresses imparted to the guide when it is forced onto the balustrade as will be set forth in greater detail hereinafter. Planar terminal clamping surfaces 10 and 10' are formed at inner terminal portions of the guide, the clamping surfaces 10 and 10' being connected to the spring wings 8 and 8' by a plurality of radiused portions, 12, 14, 16 and 12', 14', 16', respectively, which are also stressed locally when the guide is pressed onto the balustrade. The distance D between the clamping surfaces 10 and 10' is less than the combined thickness of the glass balustrade and gasket, preferably about 95% of said combined thickness. It will be noted that when the surfaces 10 and 10' are forced apart to receive the top margin of the balustrade 18, the stressed zones 8, 12, 14 and 8', 12' 14' will bias the surfaces 10 and 10' counterclockwise and clockwise respectively and against the balustrade. At the same time the stressed zones 16 and 16' will bias the surfaces 10 and 10' directly toward each other and against the balustrade 18.

The pressure exerted by the clamping surfaces 10 and 10' is sufficiently high to ensure a secure connection while ensuring that the balustrade will not be damaged. A paper gasket 20 is mounted on the top margin of the balustrade 18 and is sandwiched between the clamping surfaces 10 and 10'. The gasket 20 provides additional protection to the joint and prevents direct contact between the glass and steel. The gasket 20 is preferably pressboard having a thickness of about 1 mm. The gasket can alternatively be formed from a plastic material which is polyethylene, polypropylene or the like. The gasket 20 is preferably simply placed on top of the balustrade 18 and the guide 2 is forced down over the gasket 20, as for example, by tapping the guide 2 into place with a rubber hammmer or the like. The guide 2 is secured to the balustrade by simply forcing the guide down over the paper gasketed top margin of the balustade unitl the gasket contacts the underside of the medial portion 6. The radiused corners 16 and 16' prevent tearing of the gasket 20 during the securement procedure.

It will be appreciated that the securement system of this invention is simple to use, dependable and of simplified construction. The moving handrail is securely mounted on the balustrade and there is no danger of damaging the glass balustrade with the mount system of this invention.

Since many changes and variations of the disclosed embodiment of the invention may be made without departing from the inventive concept, it is not intended to limit the invention otherwise than as required by the appended claims.

We claim:

1. In a passenger transporting structure, a handrail assembly for supporting and guiding a moving handrail, said handrail assembly comprising:

(a) a glass balustrade having a top marginal portion which is continuous and uninterrupted and which terminates in a top free edge;

(b) a gasket sheet disposed across said top free edge of said balustrade and extending down over opposite sides of said top marginal portion of said balustrade;

(c) a stationary handrail guide formed from a sheet of springy metal which has been worked into a cross-sectional configuration including an upper medial portion over which the handrail slides, a pair of curved side portions at opposite margins of said medial portion, said curved side portions forming a pair of opposed spring wings and a pair of planar clamping portions formed by opposite side edge parts of the sheet from which the handrail guide has been formed, the planar clamping portions overlying opposite outer surfaces of the gasket and being biased into clamping relationship with the balustrade with the entirety of the biasing force being generated by internal stressing of the handrail guide caused by outward deflection of the clamping portions to enable the latter to be positioned in overlying relationship with the gasket and balustrade; and (d) a handrail overlying said handrail guide and disposed in sliding relationship therewith.

2. The handrail assembly of claim 1 wherein the majority of the biasing force is generated by stressing of said spring wings.

3. The handrail assembly of claim 2 wherein the distance between said clamping portions of said handrail guide when the latter is not mounted on said balustrade and gasket is about 95% of the distance between opposite outside surfaces of said gasket when the latter is mounted over said top marginal portion of said balustrade.

4. The handrail assembly of claim 3 wherein said handrail guide is made from stainless steel, zinc-plated sheet steel or bronze sheet metal.

5. The handrail assembly of claim 4 wherein said gasket is made from pressboard.

6. The handrail assembly of claim 4 wherein said gasket is made from plastic.

* * * * *